US006314581B1

(12) United States Patent
Bond

(10) Patent No.: US 6,314,581 B1
(45) Date of Patent: Nov. 13, 2001

(54) SHIRT WITH MESSAGES UNDER COLLAR

(76) Inventor: Charles F. Bond, 11068 Bell Oaks Estate Rd., Eden Prairie, MN (US) 55344

( * ) Notice: Subject to any disclaimer, the term of this patent is extended or adjusted under 35 U.S.C. 154(b) by 0 days.

(21) Appl. No.: 09/705,159

(22) Filed: Nov. 2, 2000

(51) Int. Cl.[7] ..... A41B 1/00
(52) U.S. Cl. ..... 2/129; 2/115
(58) Field of Search ..... 2/115, 69, 80, 2/83, 129, 127, 116, 131, 133, 244, 246, 400–408, 237, 220, 221, 238, 236, 227, 228, 108, 95, 93, 85; 40/586

(56) References Cited

U.S. PATENT DOCUMENTS 4,710,981 * 12/1987 Sanchez ..... 2/115
4,991,233 * 2/1991 Hall ..... 2/115
4,999,848 * 3/1991 Oney ..... 2/115
5,084,915 * 2/1992 Shotwelkl et al. ..... 2/115
5,361,523 * 11/1994 Robison ..... 40/586
5,398,343 * 3/1995 Kuracina ..... 2/115
6,138,282 * 10/2000 Follese ..... 2/400

* cited by examiner

*Primary Examiner*—Gloria M. Hale
(74) *Attorney, Agent, or Firm*—Faegre & Benson LLP

(57) ABSTRACT

A shirt which can be used to discreetly convey messages to other persons. The shirt includes a body and a collar which is foldable between up and down positions. A message on the shirt is hidden by the collar when the collar is in the down position. The collar can be raised to the up position to expose and communicate the message.

3 Claims, 4 Drawing Sheets

SHIRT WITH MESSAGES UNDER COLLAR

FIELD OF THE INVENTION

The present invention is a garment, such as a shirt, having a concealed message or other indicia. The garment can be manipulated by the wearer to communicate the indicia to another person.

BACKGROUND OF THE INVENTION

Clothing carrying hidden messages or other indicia that can be manipulated by the wearer to expose the indicia are generally known and disclosed, for example, in the following U.S. Patents.

| Inventor | U.S. Pat. No. |
|---|---|
| Sanchez | 4,710,98l |
| Patterson et al. | 4,777,667 |
| Hall | 4,991,233 |
| Oney | 4,999,848 |
| Shotwell et al. | 5,084,915 |
| Robinson | 5,361,523 |
| Wilmers | 5,379,461 |
| Wallace | 5,794,267 |
| Krogh | 6,044,492 |

Many of the garments shown in these patents have a relatively complicated structure for concealing the indicia. The indicia-concealing structures are also somewhat conspicuous. There remains, therefore, a need for improved garments having hidden messages and other indicia. Relatively efficient-to-manufacture clothing of this type in which the indicia is discreetly hidden would be especially desirable.

SUMMARY OF THE INVENTION

The invention is an efficient-to-manufacture article of clothing that can be discreetly used to effectively communicate a message to another person in a wide range of circumstances. One embodiment of the invention includes a body portion, an indicia-bearing surface and a movable trim piece. An indicia is located on the indicia-bearing surface. The trim piece is movable between a customarily-worn position at which the trim piece extends over and conceals the indicia, and a noncustomarily-worn position at which the indicia is exposed for communication.

Another embodiment of the invention includes an outer surface and an inner surface that are opposite each other and connected at an edge, and an indicia. The inner surface is the indicia-bearing surface, and is concealed when directed inward toward the wearer in the customarily-worn position. The indicia is exposed for communication by moving the indicia-bearing surface so that it is directed outward toward another person.

DETAILED DESCRIPTION OF THE PREFERRED EMBODIMENTS

Figure 1:
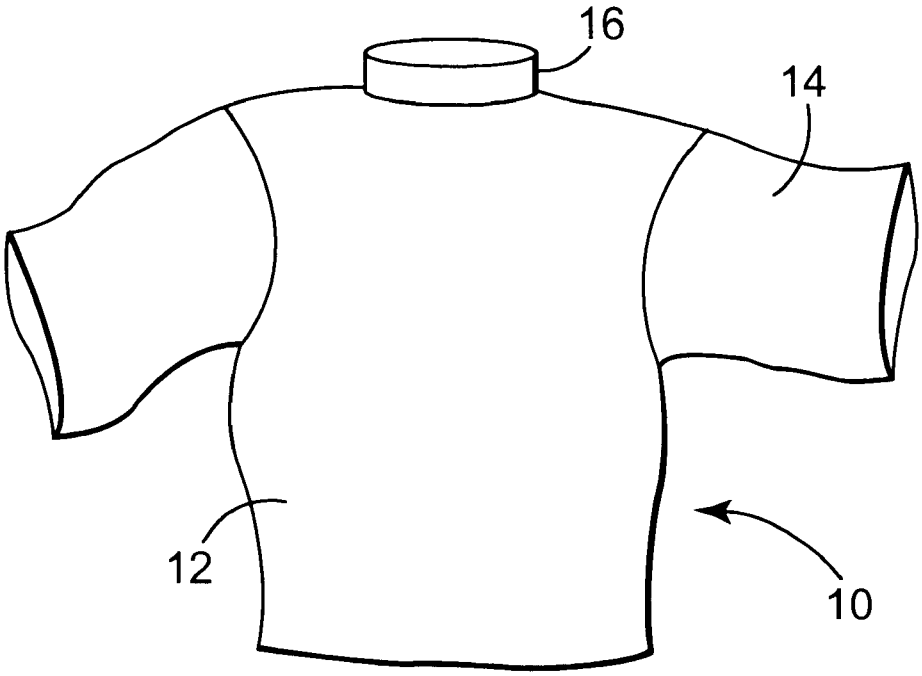
FIG. 1 is an illustration of the back side of a shirt in accordance with one embodiment of the present invention, with its collar in the down position concealing a message.
Figure 2:
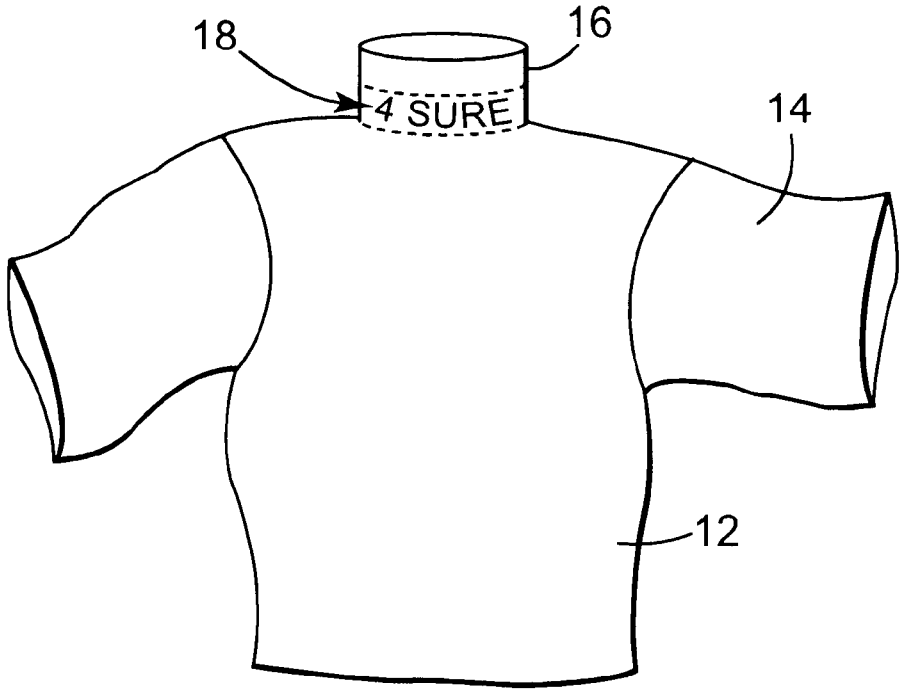
FIG. 2 is an illustration of the back side of the shirt shown in FIG. 1, with the collar in the up position to expose the message.

A shirt 10 (i.e., a garment or article of clothing) in accordance with one embodiment of the present invention is illustrated generally in FIGS. 1 and 2. In particular, the back side of a polo-type short sleeve shirt 10 is shown for purposes of example in FIGS. 1 and 2. The shirt 10 includes a body portion 12, sleeves 14 and collar 16. The collar 16 is a trim piece commonly present on shirts. The collar 16 is foldable (i.e., movable) between a conventionally-worn or down position (FIG. 1) and an up position (FIG. 2).

An indicia such as message 18 (e.g., "4SURE" in the embodiment shown) is positioned on the shirt 10 at a location at which it is concealed or hidden by the collar 16 when the collar is in its down position, and exposed when the collar is in its up position. In the embodiment shown, the message 18 is positioned at a location on the shirt 10 that is covered by the collar 14 when in its down position. Alternatively (not shown), the message 18 could be positioned on the inside surface of the collar 16. The message 18 can be formed on the shirt 10 using any conventional or otherwise known approach such as printing and embroidering. A person wearing the shirt 10 can raise the collar 14 at a desired time to expose and communicate the message 18 to another person.

An advantage of the shirt 10 is that the collar 14 is a trim piece commonly found on shirts. The shirt 10 can therefore be manufactured efficiently with no "added" expense other than that associated with the formation of the message 18. In other words, no structure is added to the shirt 10 solely or substantially for the purpose of enabling the concealment and exposure of the message 18. Furthermore, the fact that the collar 14 is a conventional trim piece facilitates the discreet concealment of the message 18. Other persons to whom the message 18 is to be communicated will not be suspicious or have their attention drawn to the collar, as can happen with unconventional or otherwise conspicuous or unusual structures that are present primarily or solely for purposes of hiding the message. The shirt 10 can thereby be used to communicate the message 18 to another person with a high degree of surprise.

Other garments such as other types of shirts (e.g. rugby shirt, turtleneck) and jackets (not shown) can also include collars and messages that are functionally similar to those described above. The invention can also be incorporated into other types of trim pieces commonly found on shirts and jackets such as sleeve cuffs, pocket flaps and lapels. In yet other embodiments, the invention can be incorporated into trim pieces having characteristics such as those described above on still other types of clothing and accessories. Examples include leg cuffs and pocket flaps on pants.

Figure 3:
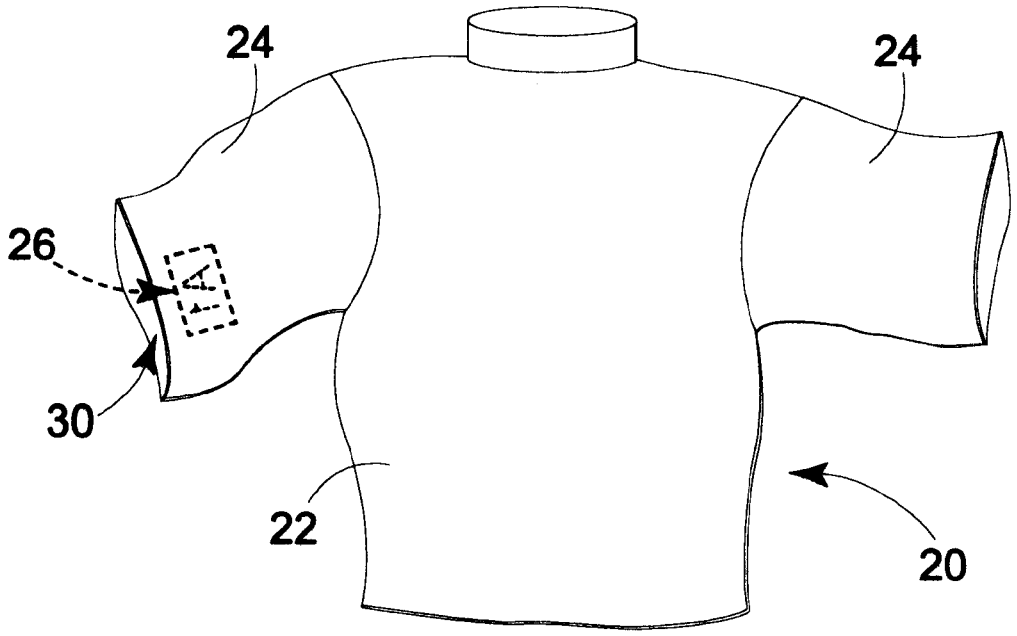
FIG. 3 is an illustration of a shirt in accordance with another embodiment of the present invention, showing a shirt in the conventionally-worn position. The shirt includes an indicia-bearing surface facing inward, toward the wearer, to conceal an indicia.
Figure 4:
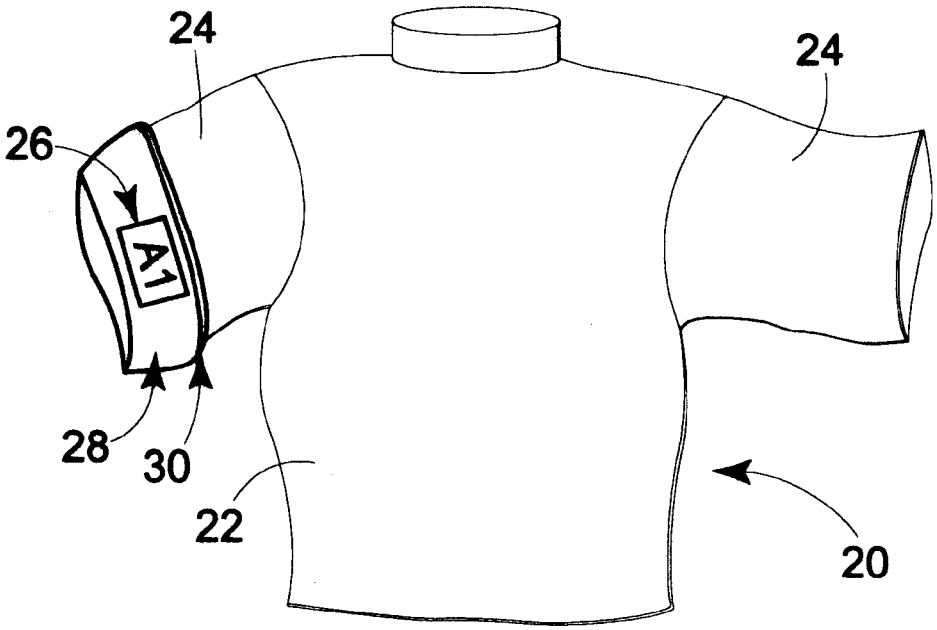
FIG. 4 is an illustration of the shirt shown in FIG. 3, with the indicia-bearing surface folded outward to reveal the indicia.

An example of a shirt 20 in accordance with a second embodiment of the present invention is shown in FIGS. 3 and 4. The shirt 20 includes a body portion 22 and sleeve 24. An indicia-bearing surface 28 on the inside surface of the sleeve 24, adjacent to the end or edge 30 of the sleeve, has an indicia 26 (e.g. "A1" in the embodiment shown). In the customarily-worn position shown in FIG. 3, the indicia-bearing surface 28 faces or is oriented inward toward the wearer, and the indicia 26 is concealed. However, the indicia-bearing surface 28 is sufficiently close to the edge 30 of the sleeve 24 that by moving the edge 30 of the sleeve to a noncustomarily-worn position, the surface 28 can be exposed outwardly to reveal the indicia 26, as shown in FIG. 4. The sleeve 24 is foldable, rollable, or twistable (i.e. movable).

An advantage of shirt 20 is that the indicia 26 can be discreetly concealed until an appropriate time as determined by the wearer. The sleeve 24 appears as an ordinary sleeve to an observer, until the wearer decides to reveal the indicia 26. Furthermore, this embodiment can be carried out using a basic shirt such as an ordinary T-shirt, with no need for the addition of extra trim or flaps to conceal the indicia 26. The indicia-bearing surface 28 is located adjacent to the edge 30 of the shirt 20, which is typically present on such shirts. In other words, the indicia-bearing surface 28 of the shirt 20 is not located adjacent to an edge that has been added substantially or solely to accommodate the indicia 26.

The embodiment of the invention described with reference to FIGS. 3 and 4 can be realized using different inner surfaces of a garment, such as the underside of a sleeve cuff, the inside surface of a waistband, the backside of a shirt tail, etc. The invention can also be incorporated into garments other than a shirt or pants (not shown).

Shirts such as 10 and 20 and other embodiments of the invention can be used by the person wearing the garment to communicate messages to others in an effective manner under a wide range of circumstances. For example, they can be used to express clever messages to other players at opportune times on a golf course. Any of a wide variety of indicia and messages such as logos, slang and short phrases can be communicated.

Although the present invention has been described with reference to preferred embodiments, those skilled in the art will recognize that changes can be made in form and detail without departing from the spirit and scope of the invention.

What is claimed is:

1. A shirt, including:

a body;

a collar which is foldable between up and down positions; and an indicia which is hidden by the collar when the collar is in the down position, and which is exposed for communication when the collar is raised to the up position.

2. The shirt of claim 1 wherein the indicia includes a message.

3. The shirt of claim 2 wherein the message is on the back of the shirt and hidden by the rear portion of the collar.

* * * * *